US010939747B2

(12) United States Patent
Mikitovic et al.

(10) Patent No.: US 10,939,747 B2
(45) Date of Patent: Mar. 9, 2021

(54) HAIR BRUSH

(71) Applicant: Conair Corporation, Stamford, CT (US)

(72) Inventors: Jessica Anna Mikitovic, New Rochelle, NY (US); Elizabeth Luan Wei, Old Greenwich, CT (US)

(73) Assignee: Conair Corporation, Stamford, CT (US)

( * ) Notice: Subject to any disclaimer, the term of this patent is extended or adjusted under 35 U.S.C. 154(b) by 794 days.

(21) Appl. No.: 15/672,821

(22) Filed: Aug. 9, 2017

(65) Prior Publication Data

US 2019/0045912 A1 Feb. 14, 2019

(51) Int. Cl.

| | |
|---|---|
| ***A46B 9/02*** | (2006.01) |
| ***A46B 5/02*** | (2006.01) |
| ***A45D 24/00*** | (2006.01) |
| *A46B 1/00* | (2006.01) |

(52) U.S. Cl.

CPC ..... *A46B 9/023* (2013.01); *A45D 24/00* (2013.01); *A46B 5/02* (2013.01); *A46B 1/00* (2013.01); *A46B 2200/104* (2013.01)

(58) Field of Classification Search

CPC ..... A45D 20/10; A45D 20/48; A45D 20/50; A45D 20/52; A45D 20/525; A45D 2040/0025; A45D 24/00; A46B 15/0051; A46B 2200/104; A46B 3/08; A46B 5/02; A46B 9/02; A46B 9/023; A46D 1/02; A46D 1/0238; A46D 1/0246

USPC ..... 132/110, 113, 114, 118, 210, 211, 223; 211/10; D4/136

See application file for complete search history.

(56) References Cited

U.S. PATENT DOCUMENTS

| | | | | | |
|---|---|---|---|---|---|
| 2,599,191 | A * | 6/1952 | Meunier | A46B 9/005 | 15/167.1 |
| 3,696,818 | A * | 10/1972 | Weber | A45D 20/52 | 132/118 |
| 3,903,905 | A * | 9/1975 | Tucker | A45D 20/10 | 132/118 |
| 4,500,939 | A * | 2/1985 | Gueret | A46B 3/005 | 15/187 |
| 5,657,775 | A * | 8/1997 | Chou | A46B 7/04 | 132/125 |
| D823,005 | S * | 7/2018 | Kuo | D4/128 | |
| D839,607 | S * | 2/2019 | Kuo | D4/134 | |
| 2003/0088932 | A1* | 5/2003 | Gardiner | A46B 5/026 | 15/167.1 |

(Continued)

*Primary Examiner* — Yogesh P Patel
*Assistant Examiner* — Jennifer Gill
(74) *Attorney, Agent, or Firm* — Ohlandt, Greeley, Ruggiero & Perle, L.L.P.

(57) ABSTRACT

A hair brush has a semi-circular configuration, and has a head having a support member with a plurality of apertures therein that accommodate a plurality of bristles each having a hollow therein, and has a rear having an elongated hollow therein that complements the semi-circular configuration. When air is applied to the bristles, each bristle communicates with the aperture so that air can flow through the openings of the bristles, the aperture and outward through the hollow in the rear of the hair brush and away from the hair of a user. When air is applied to the hollow in the rear, the air is directed through the apertures and bristles onto the hair of the user.

10 Claims, 7 Drawing Sheets

(56) References Cited

U.S. PATENT DOCUMENTS

| | | | | |
|---|---|---|---|---|
| 2008/0105270 | A1* | 5/2008 | Walters | A46B 9/023<br>132/112 |
| 2019/0045911 | A1* | 2/2019 | Mikitovic | A46B 1/00 |

* cited by examiner

HAIR BRUSH

BACKGROUND OF THE DISCLOSURE

1. Field of the Disclosure

The present disclosure relates generally to a hair brush having a semi-circular configuration. More particularly, the present disclosure relates to a hair brush having a semi-circular configuration with a vented bristle head portion and a hollowed rear portion that allows air to pass through the body of the hair brush in either direction.

2. Description of Related Art

Professional hairstylists worldwide routinely employ a set of tools for shaping and styling hair. Among these are hair brushes and hand-held, electrically-heated "hairdryers", also known as "blow dryers". The hair brushes manipulate the hair as a flow of heated air generated by the hairdryer assists in setting the shape of the individual's hair. To style hair in a particular shape, many people blow hot air to dry their hair as they brush it. While simultaneously blowing drying and brushing hair, heat, such as in the form of hot air, is applied directly to the hair, and thus the hot air pushes against the hair while blowing. The unwanted hot air can sometimes deform the hair that has been shaped and styled. Also, the unnecessary hot air can cause uncomfortableness for some individuals.

Accordingly, there is a need for a hair brush to direct unwanted and/or unnecessary hot air from the hairdryers.

SUMMARY

The present disclosure provides such a hair brush that has a semi-circular configuration with a head or bristle portion and a back or rear portion having an elongated hollow therein that complements the semi-circular configuration.

The present disclosure also provides such a hair brush in which the head has a support member with a plurality of apertures therein that accommodate a plurality of bristles each having an opening or hollow therein, and the plurality of bristles projects outward from the support member to form a semi-round profile of bristle heads.

The present disclosure in addition provides such a hair brush that air can be applied to either the bristle side or the rear of the hair brush and the air flows out the other side of brush head.

The present disclosure further provides that each bristle has a geometric shape, preferably triangular, with an opening or hollow that communicates with the aperture so that when positioned through the aperture, air can flow through the openings in the bristles and the aperture and outward through the hollow in the back of the hair brush and away from the hair of a user.

The present disclosure still further provides such a hair brush in which the hollow in the back of the hair brush can funnel air applied thereto through the apertures in the support member and bristles in the apertures to allow heated air from an air source, such as a hair dryer, applied to the hair to effect curling and/or shaping of the hair.

The present disclosure also provides such a hair brush having a head with two alternating patterns of rows of triangular shaped bristles having a hollow therein that result in alternating flat and tapered profiles on the head that can cause the hair to intermittently be separated and spread when the brush is pulled through the hair.

The present disclosure still further provides that the plurality of bristles are in rows along the longitudinal axis of the head with each adjacent row of bristles positioned perpendicular or 90 degrees with respect to the adjacent row so that successive bristles are orthogonal with respect to each other.

The above-described and other advantages and features of the present disclosure will be appreciated and understood by those skilled in the art from the following detailed description, drawings and appended claims.

BRIEF DESCRIPTION OF THE DRAWINGS

In the description of the embodiment below, the components referenced by the same numbers perform the same operations throughout the embodiment, and repetitive descriptions will be omitted for brevity.

DETAILED DESCRIPTION OF THE DISCLOSURE

Figure 1:
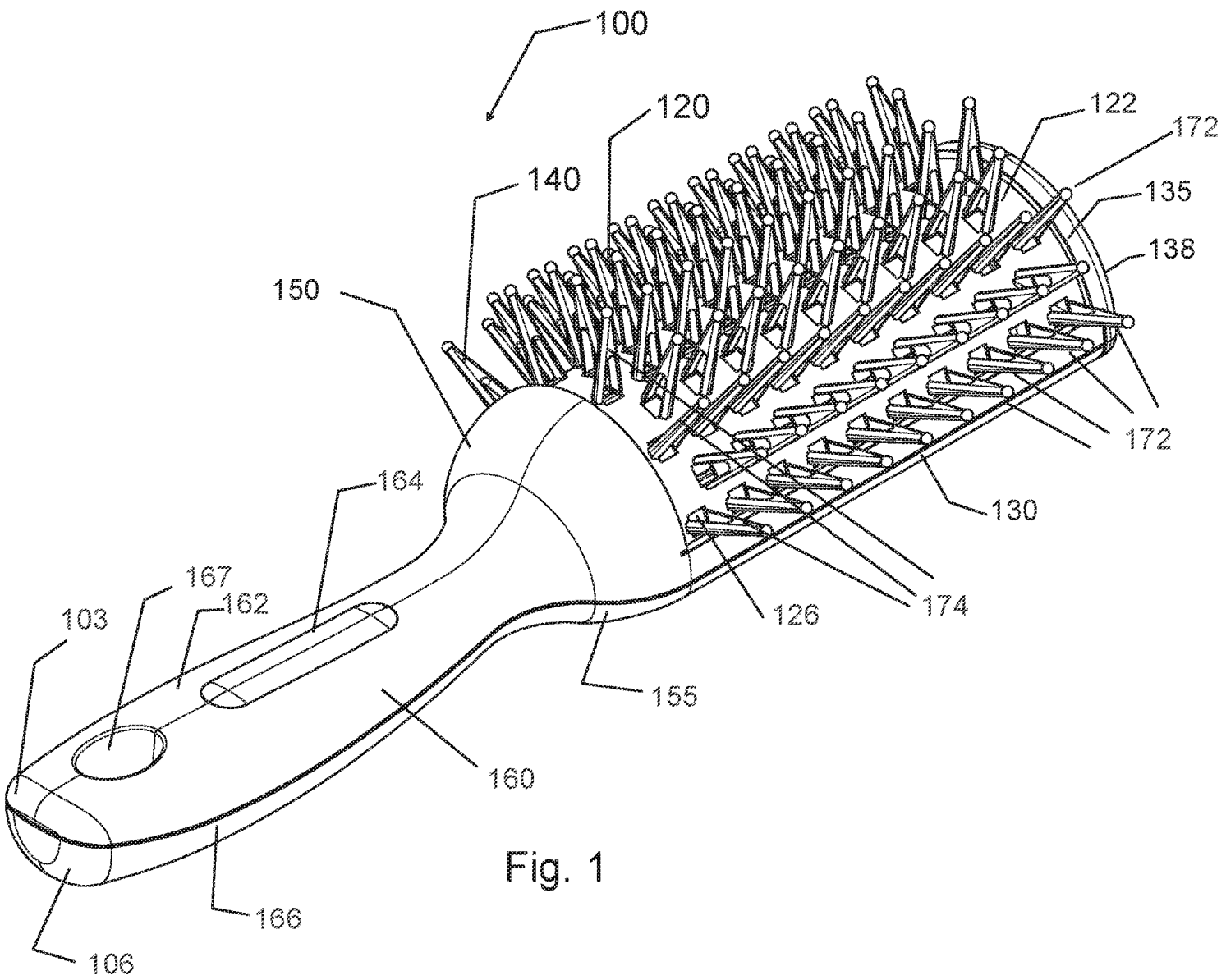
FIG. 1 is a top, back perspective view of the hair brush of the present disclosure.
Figure 2:
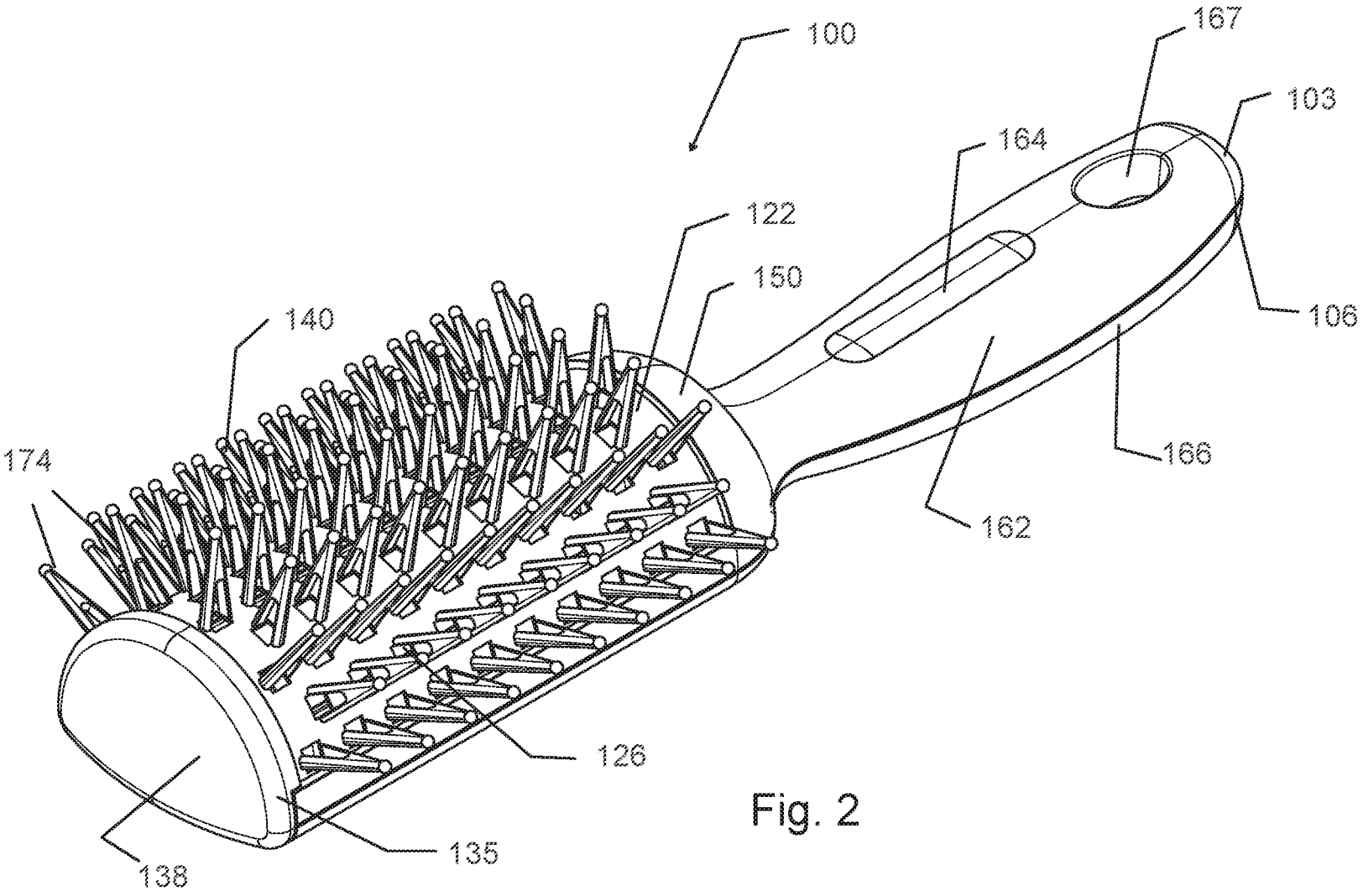
FIG. 2 is a top, front perspective view of the hair brush of FIG. 1.

Referring to the drawings and, in particular to FIGS. 1 and 2, the present disclosure relates to a hair brush generally represented by reference numeral 100.

Hair brush 100 has a head portion 120, a handle or handle portion 160, and a connector portion 150 having a lower portion 155 that connects the head portion 120 to the handle portion 160. Handle 160 has an upper edge portion 162 and a lower portion 166 that ends in upper and lower edges portions 103, 106, respectively.

Figure 3:
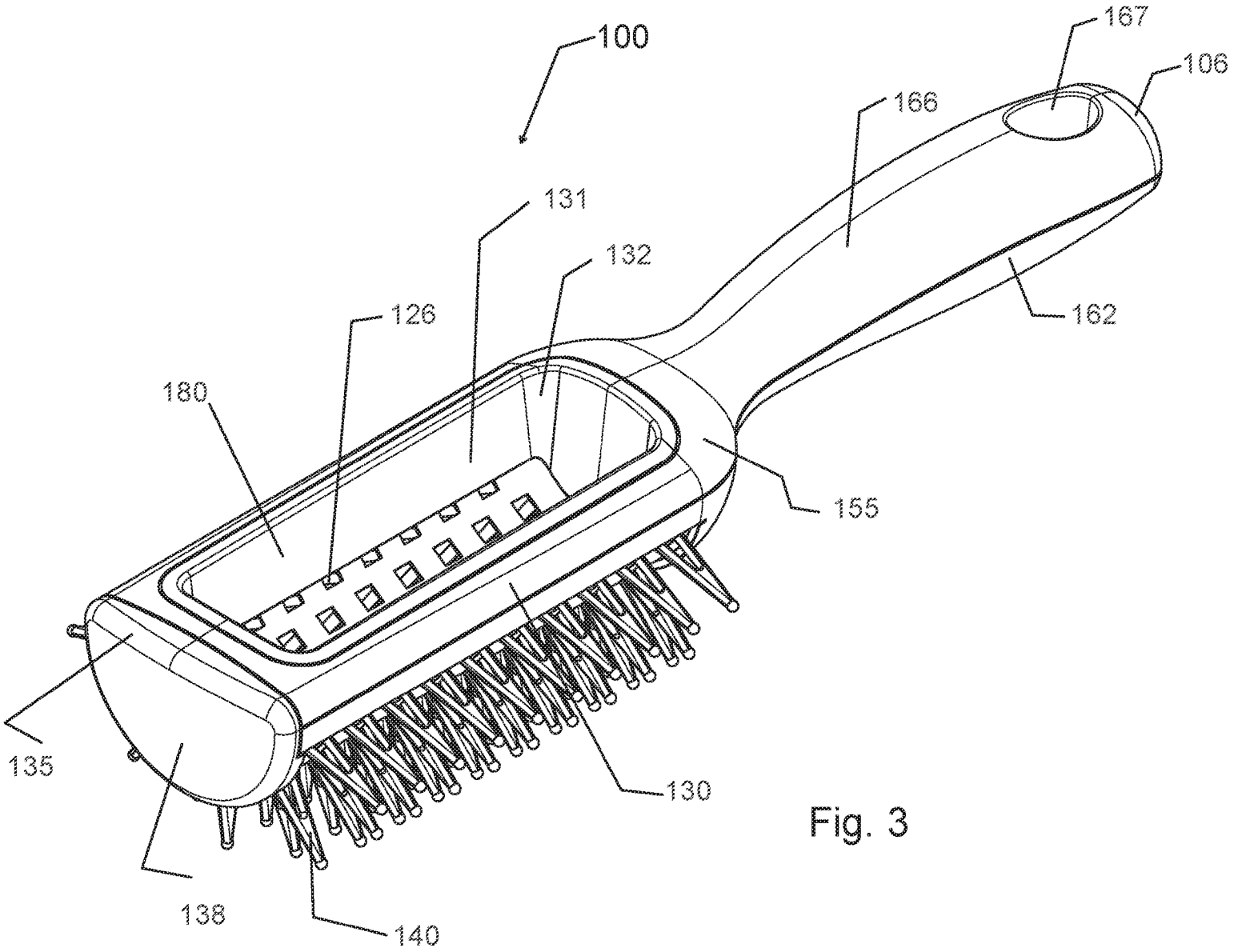
FIG. 3 is a bottom, front perspective view of the hair brush of FIG. 1.
Figure 4:
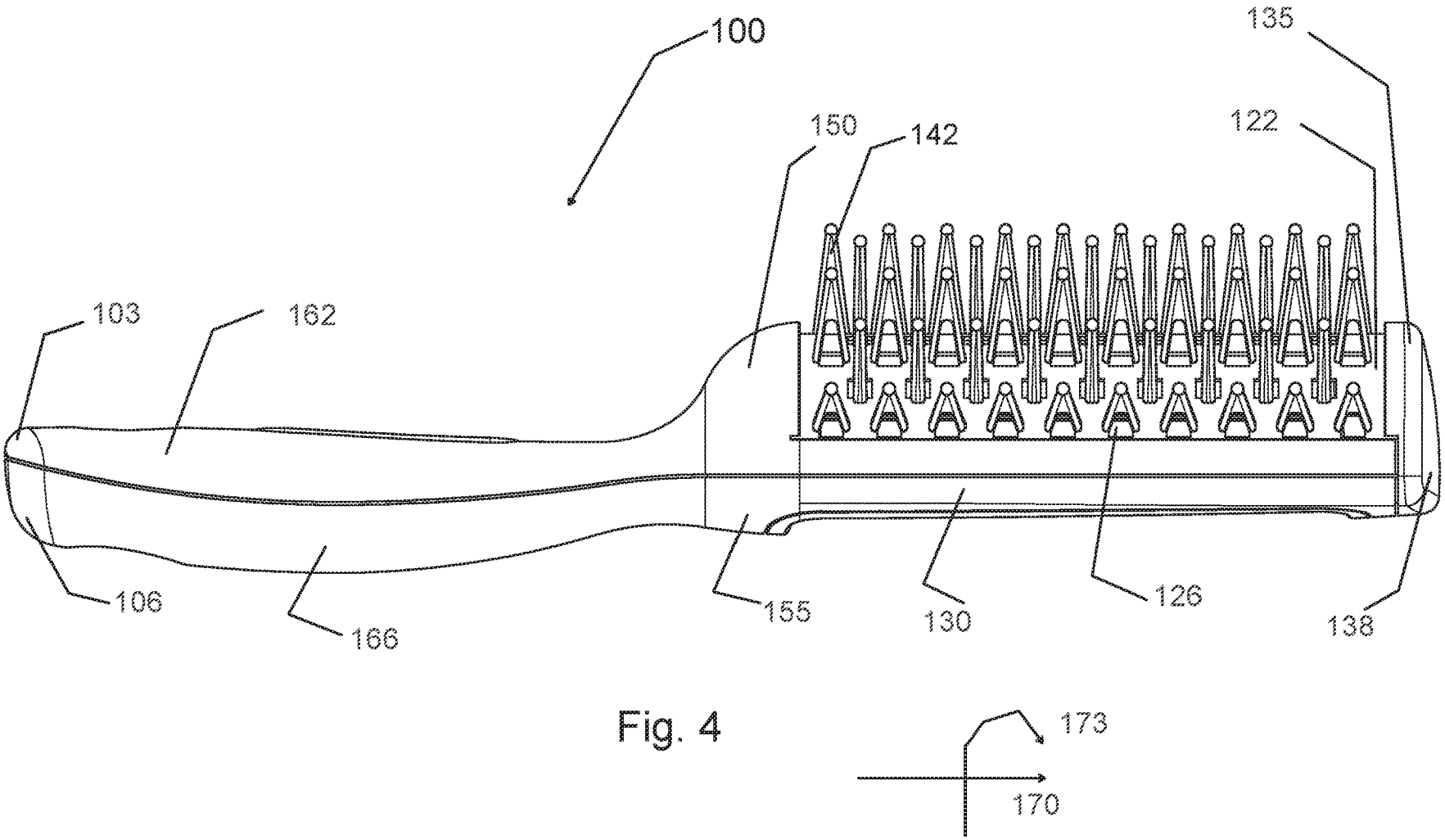
FIG. 4 is a front view of a hair brush of FIG. 1.

Head portion 120 has a rounded convex support member 122 and a back or rear portion 130 shown in FIG. 3. Back 130 has an end member 135 that is connected to support member 122 (as shown in FIG. 4). Edge member 135 preferably has a cushion member 138 for comfort when the user stokes his/her hair.

Support member 122 has a plurality of apertures 126 that accommodate a plurality of bristles 140. Bristles 140 project outward from support member 122 to form a semi-round profile.

Figure 6:
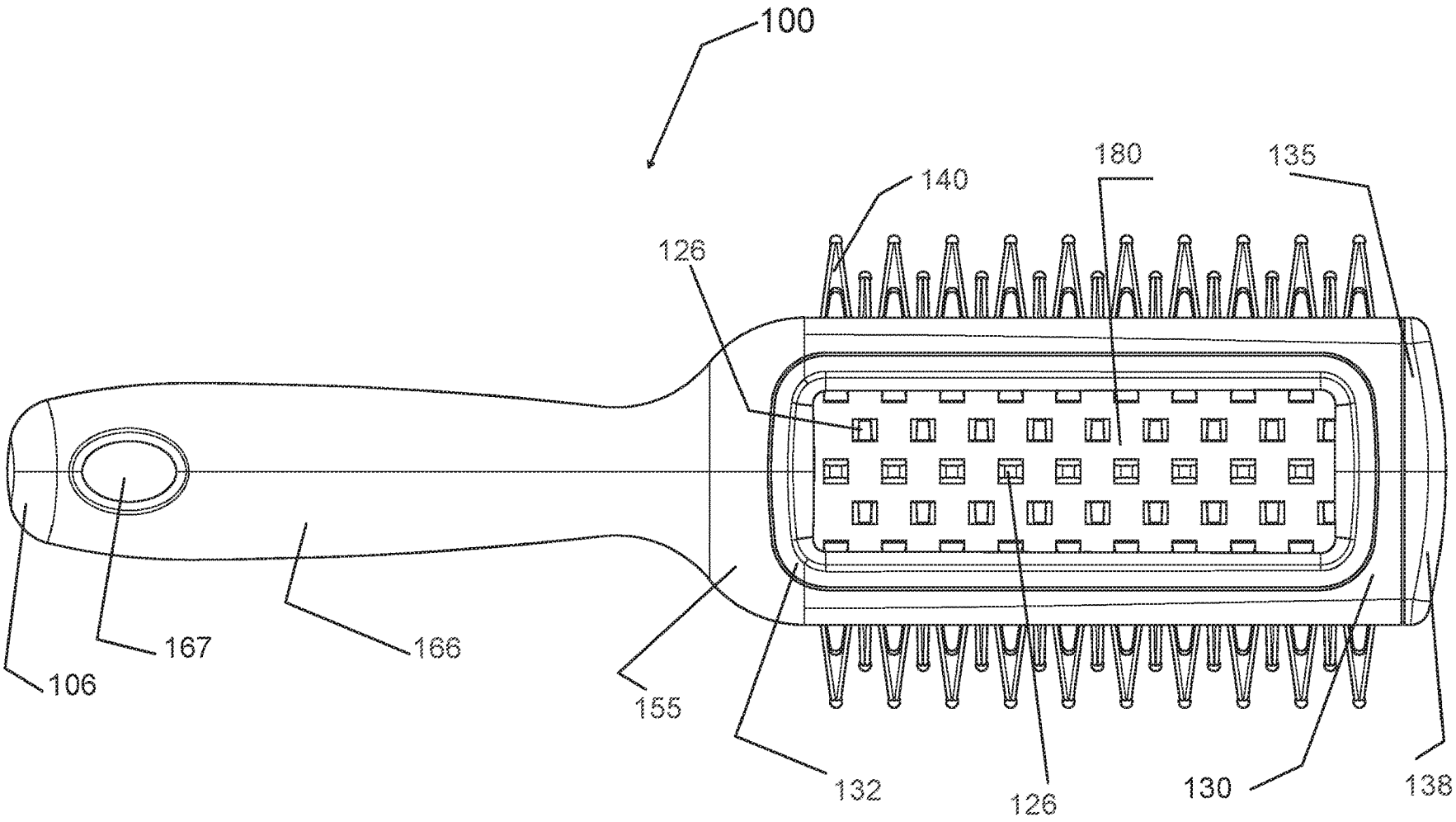
FIG. 6 is a bottom view of the hair brush of FIG. 1.
Figure 7:
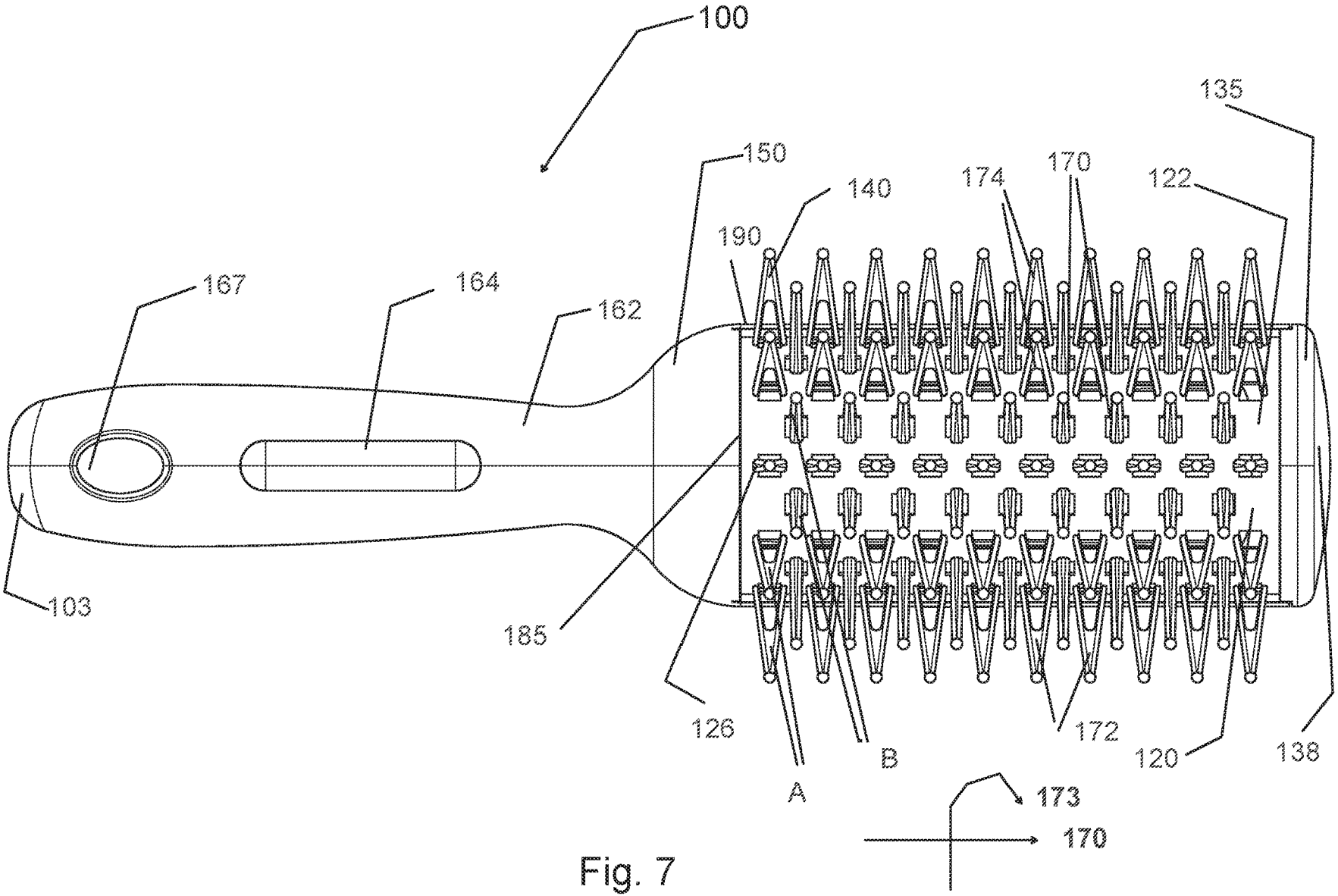
FIG. 7 is a top view of the hair brush of FIG. 1 with one row of bristles removed.

Each aperture 126 has the same shape as shown in FIGS. 1, 3 and 6. In one embodiment, each aperture 126 has a squared shape, as shown in FIG. 6. In another embodiment, each aperture 126 has a rectangular shape, as shown in FIG. 7.

Referring to FIG. 3, back 130 has a hollow 131 with tapered walls 132. Preferably, hollow 131 is elongated to provide a large amount of flow of air into and out of the hollow. Hollow 131 has a base that is the back of support member 122 so that apertures 126 through support member 122 are also thus through the base. The tapered walls 132 assist in directing air flow received from apertures 126 away from hair brush 100, and directing air flow applied to back 130 into apertures 126.

The handle or handle portion 160 has an upper handle portion 162 and a lower handle portion 166 that can be connected or alternatively formed as one integral structure. The handle 160 has an opening 167 through the handle. Opening 167 can be used to secure the hair brush 100 on a hook. The upper handle portion 162 preferably has a slot 164. The slot 164 is preferably horizontal to decrease the weight of handle 160.

Figure 5B:
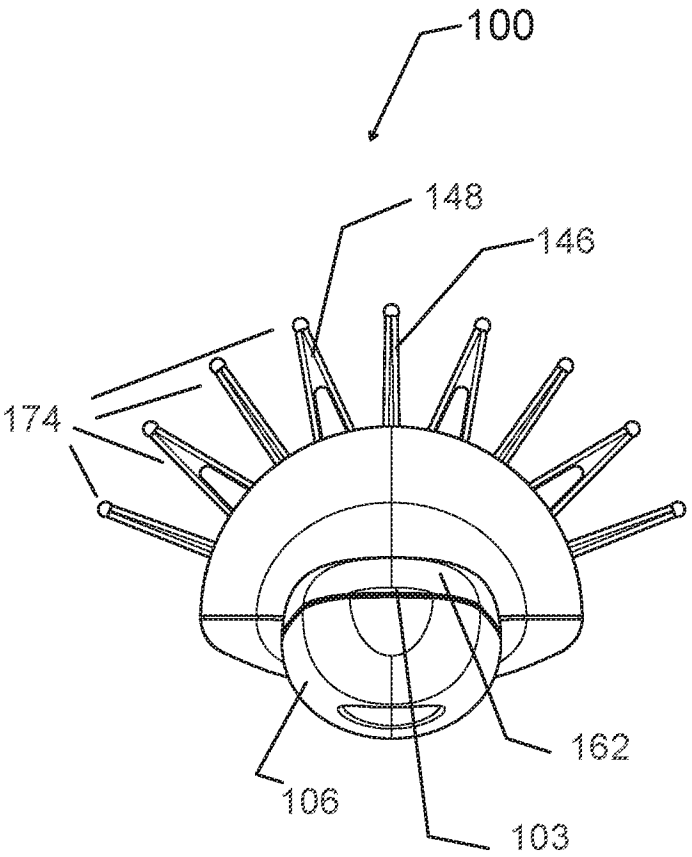
FIG. 5*b* is a second end view opposite the first end view of the hair bush of FIG. 1.
Figure 5A:
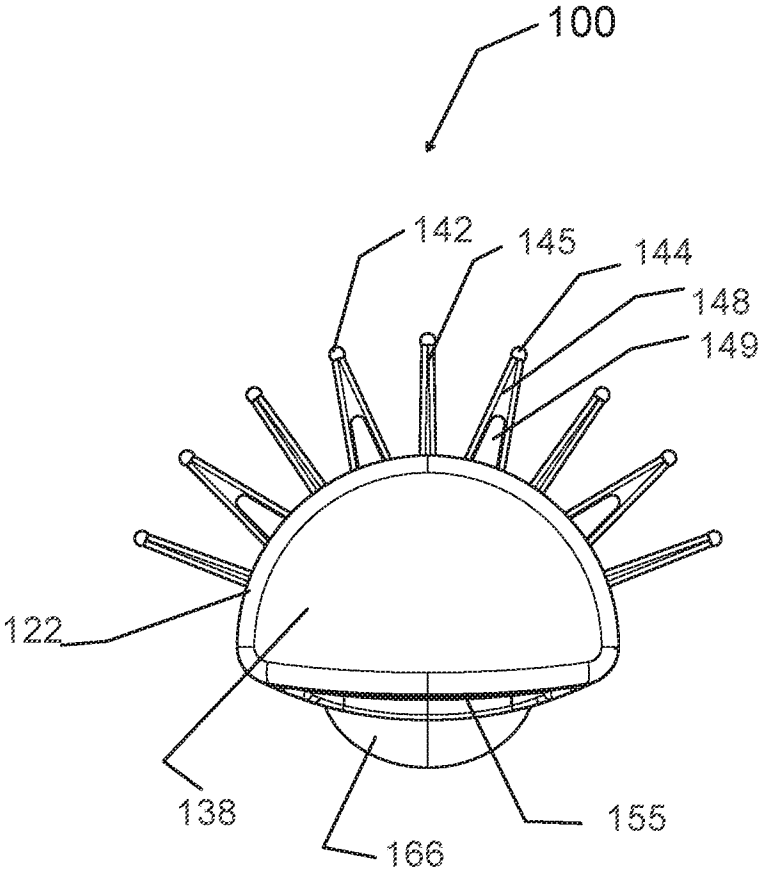
FIG. 5*a* is a first end view of the hair brush of FIG. 1.

Referring to FIGS. 4, 5*a* and 5*b*, each bristle 142 of the plurality of bristles 140 has a round head 144, a pair of outer ribs 145,146 and an inner fin or rib 148. The inner fin 148 along with outer ribs 145, 146 and support member 122 form an opening or aperture 149. To assist in retaining the shape of each bristle 142, inner fin 148 has an accurate shaped portion 147 to maintain the integrity of outer ribs 145, 146.

Referring to FIG. 7, the plurality of apertures 126, and thus plurality of bristles 140, is disposed in a row 172 along a longitudinal axis 170 in a single straight line parallel to edge 190 and perpendicular to edge 185. Also, apertures 126 and thus bristles 140 are disposed in columns 174 that curve along the latitudinal direction 173 as shown in FIG. 7.

Referring to FIGS. 1 and 7, each adjacent pair of apertures 126 of each row 172 has a same distance therebetween. Likewise, each adjacent pairs of apertures 126 in each column 174 has a same distance therebetween.

In one embodiment, adjacent first and second rows of apertures 126 are disposed alternatively on support member 122 along longitudinal axis 170. Each bristle 140 accommodated in the first row of apertures 126 is preferably perpendicular, or alternatively virtually perpendicular, to each bristle accommodated in the second row of apertures 126.

In one embodiment, adjacent first and second columns A, B of apertures, indicate as columns A and B, respectively, in FIG. 7, are disposed alternatively on support member 126 along latitudinal axis 173. Each bristle 126 accommodated in first column A is perpendicular (or virtually perpendicular) to each bristle 126 accommodated in second column B of apertures 126. Each bristle 140 accommodated in first column A of aperture 126 is disposed along longitudinal axis 170.

First column A of apertures 126 is oriented to be perpendicular (or virtually perpendicular) to each row of apertures 126.

Each aperture 126 in each row is separated from an adjacent aperture along the longitudinal axis by a first constant distance. Likewise, each aperture 126 of first column A is separated along the latitudinal axis from an adjacent aperture of second column B by a second distance. In one embodiment, the first and second distances are equal.

As shown in the figures, especially FIGS. 1, 2, 4, 5*a*, 5*b* and 6, in the preferred embodiment, every bristle 140 in one row is positioned in the same direction and that direction is perpendicular (90 degrees) with respect to all bristles in the adjacent rows. By this pattern, which is an alternating pattern, successive bristles 140 are oriented orthogonally with respect to each other to create an alternating flat and taped profile as shown in FIGS. 6 and 7. By this alternating pattern, hair is separated and spread intermittently when brush 100 is combed or pulled through a user's hair.

Further, each bristle 140 with outer ribs 145, 146 that extend outward from head 144 and opening aperture 149 creates an elongated hollow or opening 180 through support member 126 as shown more clearly in FIGS. 3 and 6. By this structure, when air comes across bristles 140, the air will pass through apertures 126 and be directed to the ambient environment through wide opening 180.

Also, when air is directed into elongated hollow or opening 180, the air will be directed through apertures 126 and bristles 140 to assist in curling and/or otherwise shaping the hair. This feature is especially important, where curling and/or shaping of one's hair, without direct impact or contact by a hair dryer on one's hair is important. Thus, the configuration of hair brush 100 with this opening 180 provides the effect of a curling iron to assist in curling or shaping the hair.

As shown in FIGS. 1, 2 and 3 in one embodiment, head portion 120, connector portion 150 and handle 160 can be formed as one piece, or any combination of two parts can be formed as one piece provided connected to the third piece. In another embodiment, handle 160 can have a lower or rear portion 161 and an upper portion 162 that are connected. Likewise, head portion 120 can be two pieces that are connected. The formation of hair brush 100 in separate pieces that are connected can assist in placing voids or spaces in the hair brush to lighten the weight of the hair brush.

It should be noted that the terms "first", "second", "third", and the like may be used herein to modify various elements. These modifiers do not imply a spatial, sequential or hierarchical order to the modified elements unless specifically stated.

While the present disclosure has been described referring to one or more exemplary embodiments, it will be understood by those skilled in the art that various changes can be made and equivalents may be substituted for elements thereof without departing from the scope of the present disclosure. In addition, modifications can be made to adapt a particular situation or material to the teachings of the present disclosure without departing from the scope thereof. Therefore, it is intended that the present disclosure will not be limited to the particular embodiment(s) disclosed as the best mode contemplated, but that the present disclosure will include all embodiments falling within the scope of the appended claims.

What is claimed is:

1. A hair brush comprising:

a head portion having a semi-circular cross-section and a longitudinal axis;

an opening extending from a back to a front of the head portion having a rectangular shape with a length that is substantially the same as a longitudinal length of the head portion;

a convex support member spanning the opening in the head portion, the convex support member having a plurality of apertures; and a plurality of bristles extending from the convex support member, each of the plurality of bristles forming a flattened triangular shape having a linear base defined at a bottom of the triangular shape and a hole formed through each of the plurality of bristles, the plurality of bristles being arranged in longitudinal rows relative to the longitudinal axis defined by the head portion, the longitudinal rows forming a plurality of primary rows having a portion of the plurality of bristles with each linear base aligned parallel to the longitudinal axis of the head portion and a plurality of secondary rows having another portion of the plurality of bristles with each linear base aligned perpendicular to the longitudinal axis of the head portion, and the plurality of secondary rows each being adjacent to at least one of the plurality of primary rows.

2. The hair brush of claim 1, wherein the convex support member has the plurality of bristles extending therefrom from a first side and a rear portion opposite the first side that forms a hollow portion with tapered walls.

3. The hair brush of claim 1, wherein each of the plurality of bristles is aligned with a different one of the plurality of apertures through the convex support member.

4. The hair brush of claim 1, wherein each of the plurality of bristles has a pair of outer ribs and an inner fin forming the flattened triangular shape having the linear base defined at the bottom of the triangular shape and the hole formed through each of the plurality of bristles.

5. The hair brush of claim 4, wherein each of the plurality of bristles has a round head where the pair of outer ribs connect.

6. The hair brush of claim 1, wherein the plurality of secondary rows that are each adjacent to the at least one of the plurality of primary rows are separated from one another by a first constant distance, and each adjacent pairs of bristles of the plurality of bristles are separated from each other along the longitudinal axis by a second constant distance.

7. The hair brush of claim 6, wherein the first and second constant distances are the same distance.

8. The hair brush of claim 1, wherein the plurality of bristles are formed in a plurality of columns along a latitudinal axis of the head portion with each adjacent pair of the plurality of columns having a portion of the plurality of bristles positioned perpendicular with respect to one another.

9. The hair brush of claim 8, wherein the plurality of columns along the latitudinal axis of the head portion have a first column formed by a first portion of the plurality of bristles that are separated from an adjacent second column formed by a second portion of the plurality of bristles by a third constant distance, and each adjacent pairs of bristles in each the first column and the second column are separated from each other along the latitudinal axis by a fourth constant distance.

10. The hair brush of claim 9, wherein the third and fourth constant distances are the same distance.

* * * * *